US010068738B2

(12) United States Patent
Munehiro

(10) Patent No.: US 10,068,738 B2
(45) Date of Patent: Sep. 4, 2018

(54) TRAVELING WAVE TUBE AND HIGH-FREQUENCY CIRCUIT SYSTEM

(71) Applicant: NEC Network and Sensor Systems, Ltd., Fuchu-shi, Tokyo (JP)

(72) Inventor: Takatsugu Munehiro, Tokyo (JP)

(73) Assignee: NEC NETWORK AND SENSOR SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/319,845

(22) PCT Filed: Jun. 26, 2015

(86) PCT No.: PCT/JP2015/003234
§ 371 (c)(1),
(2) Date: Dec. 19, 2016

(87) PCT Pub. No.: WO2016/002183
PCT Pub. Date: Jan. 7, 2016

(65) Prior Publication Data

US 2017/0140892 A1 May 18, 2017

(30) Foreign Application Priority Data

Jun. 30, 2014 (JP) ..... 2014-133645

(51) Int. Cl.
*H01J 25/34* (2006.01)
*H01J 23/087* (2006.01)
(Continued)

(52) U.S. Cl.
CPC ..... *H01J 23/087* (2013.01); *H01J 23/027* (2013.01); *H01J 23/04* (2013.01); *H01J 23/065* (2013.01)

(58) Field of Classification Search
CPC ..... H01J 23/0275; H01J 23/0873; H01J 25/34
(Continued)

(56) References Cited

U.S. PATENT DOCUMENTS 2,841,739 A 7/1958 Pierce
2,886,738 A 5/1959 Tien
(Continued)

FOREIGN PATENT DOCUMENTS

EP 0144317 A1 6/1985
EP 0589606 A2 3/1994
(Continued)

OTHER PUBLICATIONS

Japanese Office Action for JP Application No. 2014-133645 dated Jun. 30, 2015 with English Translation.
(Continued)

*Primary Examiner* — Tung X Le

(57) ABSTRACT

Provided are a traveling wave tube and a high-frequency circuit system such that the product life span of the traveling wave tube operating in multiple modes can be extended while variations in gain and amplification efficiency that accompany switching of the operation modes can be suppressed. The traveling wave tube comprises: an electron gun equipped with a cathode that releases electrons, and a heater that provides the cathode with heat energy for releasing the electrons; a helix causing an RF signal to interact with an electron beam formed from the electrons released by the electron gun; a collector for catching the electron beam emitted by the helix; an anode whereby the electrons released from the electron gun are guided into the helix; and a magnetic field application device for generating a magnetic field in order to change the diameter of the electron beam, said magnetic field application device being supplied with electric power for generating the magnetic field from the outside.

20 Claims, 7 Drawing Sheets

(51) Int. Cl.
*H01J 23/04* (2006.01)
*H01J 23/065* (2006.01)
*H01J 23/027* (2006.01)

(58) Field of Classification Search
USPC ..... 315/3.5, 5.38, 39, 39.3
See application file for complete search history.

(56) References Cited

U.S. PATENT DOCUMENTS

| | | | | | |
|---|---|---|---|---|---|
| 2,945,153 | A | | 7/1960 | Chang | |
| 3,755,706 | A | | 8/1973 | Scott | |
| 5,109,179 | A | | 4/1992 | Faillon et al. | |
| 5,604,401 | A | | 2/1997 | Makishima | |
| 5,694,005 | A | * | 12/1997 | Goebel | H01J 23/065 315/39 |
| 5,959,406 | A | * | 9/1999 | Hart | H01J 23/087 29/600 |
| 6,369,511 | B1 | * | 4/2002 | Matsuoka | H01J 23/0275 315/3.5 |
| 6,747,412 | B2 | * | 6/2004 | Vancil | H01J 23/04 315/3.5 |
| 7,952,287 | B2 | * | 5/2011 | Barnett | H01J 25/34 315/3.5 |
| 2006/0028144 | A1 | * | 2/2006 | Chun | H01J 25/34 315/39.3 |
| 2006/0091776 | A1 | | 5/2006 | Munehiro et al. | |
| 2011/0266951 | A1 | * | 11/2011 | Andre | H01J 23/02 315/5.13 |
| 2014/0292190 | A1 | * | 10/2014 | Kasahara | H01J 25/34 315/3.5 |

FOREIGN PATENT DOCUMENTS

| | | | |
|---|---|---|---|
| JP | S58-157206 | A | 9/1983 |
| JP | S60-028137 | A | 2/1985 |
| JP | S64-035829 | A | 2/1989 |
| JP | H02-227950 | A | 9/1990 |
| JP | H07-182968 | A | 7/1995 |
| JP | H09-274865 | A | 10/1997 |
| JP | 2002-198002 | A | 7/2002 |
| JP | 2006-127899 | A | 5/2006 |
| JP | 2007-273158 | A | 10/2007 |

OTHER PUBLICATIONS

International Search Report for PCT Application No. PCT/JP2015/003234, dated Aug. 11, 2015.
English translation of Written opinion for PCT Application No. PCT/JP2015/003234.
Extended European Search Report for EP Application No. EP15815841.0 dated Feb. 8, 2018.

* cited by examiner (a)

(b)

RELATED ART

RELATED ART

TRAVELING WAVE TUBE AND HIGH-FREQUENCY CIRCUIT SYSTEM

This application is a National Stage Entry of PCT/JP2015/003234 filed on Jun. 26, 2015, which claims priority from Japanese Patent Application 2014-133645 filed on Jun. 30, 2014, the contents of all of which are incorporated herein by reference, in their entirety.

TECHNICAL FIELD

The present invention relates to a traveling wave tube, and a high-frequency circuit system equipped with a power supply device to supply the required direct-current high voltage to each electrode of the traveling wave tube.

BACKGROUND ART

The traveling wave tube is an electron tube used for the amplification of an RF (Radio Frequency) signal, the oscillation, or the like by the interaction between an electron beam emitted from an electron gun and a high-frequency circuit. For example, as shown in FIG. 6, a traveling wave tube 1 includes an electron gun 10, a helix 20, a collector 30, and an anode 40. The electron gun 10 emits electrons. The helix 20 is a high-frequency circuit in which an electron beam 50 formed of electrons emitted from the electron gun 10 interacts with the RF signal. The collector 30 captures the electron beam 50 outputted from the helix 20. The anode 40 leads out electrons from the electron gun 10 and guides the electrons emitted from the electron gun 10 inside the helix 20 that is spiral-shaped.

The electron gun 10 includes a cathode 11 which emits electrons (thermal electrons), a heater 12 which gives heat energy for emitting the electrons (thermal electrons) to the cathode 11, and a wehnelt 13 which forms the electron beam 50 by focusing the electrons emitted from the cathode 11. For example, the cathode 11 is made with a disc-shaped cathode pellet consisting of a porous tungsten base which is impregnated with an oxide (an emitter material) such as barium (Ba) or the like. For example, an electron gun (a pierced electron gun) equipped with the wehnelt 13 is described in patent literature 1 (PTL1) and the like.

The electrons emitted from the electron gun 10 are accelerated by the electric potential difference between the cathode 11 and the anode 40 while forming the electron beam 50 and guide into the helical structure of the helix 20. The electrons guided into the helical structure of the helix 20 travel through the helical structure of the helix 20 while the introduced electrons interact with an RF signal inputted from one end of the helix 20. The electron beam 50 which passes out through the helical structure of the helix 20 is captured by the collector 30. At this time, the RF signal amplified by the interaction with the electron beam 50 is outputted from the other end of the helix 20.

In the electron beam 50, because the electrons with a negative charge are repelled from each other by the coulomb force, diameter of the electron beam 50 is increased according to the travel distance of the electron. Accordingly, a periodic magnetic field generation device (not shown) which generates the magnetic field for suppressing the expansion of the electron beam 50 passing through the helical structure of the helix 20 is disposed in the periphery of the helix 20 and the diameter of the electron beam 50 is kept constant over the whole length of the helix 20 by the magnetic field generated by the periodic magnetic field generation device.

The periodic magnetic field generation device is described in, for example, patent literature 2 (PTL2).

Further, in patent literatures 3 and 4 (PTL3 and PTL4), it is described that the electron beam can be controlled by the magnetic field. In PTL3, it is described that magnetic field applying means such as a coil or the like is used for deflecting the electron beam. Further, in PTL4, it is described a structure in which in order to prevent the electron gun from being magnetized and thereby keep the trajectory of the electron beam stable, magnetic erasing means composed of a coil is disposed in the periphery of the electron gun.

As shown in FIG. 6, a negative direct-current high voltage (body voltage Ebody) determined by using an electric potential HELIX of the helix 20 as a reference is supplied to both the cathode 11 and the wehnelt 13 from a power supply device (not shown). A positive or negative direct-current voltage (in FIG. 6, a negative voltage: a heater voltage Ef) determined by using an electric potential H/K of the cathode 11 as a reference is supplied to the heater 12. A positive direct-current high voltage (an anode voltage Ea) determined by using the electric potential H/K of the cathode 11 as a reference is supplied to the anode 40. Further, a positive direct-current high voltage (a collector voltage Ecol) determined by using the electric potential H/K of the cathode 11 as a reference is supplied to the collector 30. Usually, the helix 20 is connected to a case (a body) of the traveling wave tube 1 and grounded.

FIG. 6 shows an example of a structure of the traveling wave tube 1 including one collector 30. However, the traveling wave tube 1 may have a structure in which a plurality of the collectors 30 are included. Further, FIG. 6 shows an example in which the anode voltage Ea is supplied to the anode 40. However, the traveling wave tube 1 may be used in a state in which the anode 40 is grounded. Further, FIG. 6 shows an example in which the wehnelt 13 is connected to the cathode 11. However, the traveling wave tube 1 may have a structure in which a positive or negative direct-current voltage (a wehnelt voltage Ew) determined by using the electric potential of the cathode 11 as a reference is supplied to the wehnelt 13.

In the traveling wave tube 1 shown in FIG. 6, an amount of the electrons emitted from the cathode 11 can be controlled by the anode voltage Ea and the electric power of the RF signal outputted from the traveling wave tube 1 can be controlled by the anode voltage Ea. The similar control can be performed by the wehnelt voltage Ew applied to the wehnelt 13. Further, an amount of the electrons which can be emitted from the cathode 11 depends on the temperature of the cathode 11, in other words, the temperature of the heater 12. Therefore, in the traveling wave tube 1, the heater voltage Ef is set according to the output power of the RF signal.

For example, in patent literature 5 (PTL5), it is described a structure in which the electric power of the RF signal outputted from the traveling wave tube 1 is controlled by the anode voltage Ea. In PTL5, it is described that the output power of the RF signal is controlled by the anode voltage Ea and the heater voltage Ef is adjusted according to the output power of the RF signal.

CITATION LIST

Patent Literature

[PTL1] Japanese Patent Application Laid-Open No. 2006-127899

[PTL2] Japanese Patent Application Laid-Open No. Hei 09-274865

[PTL3] Japanese Patent Application Laid-Open No. 2002-198002

[PTL4] Japanese Patent Application Laid-Open No. 2007-273158

[PTL5] Japanese Patent Application Laid-Open No. Sho 58-157206

SUMMARY OF INVENTION

Technical Problem

A case in which the electric power of the RF signal outputted from the traveling wave tube 1 is controlled by the anode voltage Ea or the wehnelt voltage Ew will be described. Namely, when the traveling wave tube 1 is operated in a multi-mode in which the traveling wave tube 1 operates at two or more RF output power levels, usually, a heater temperature is set to a temperature corresponding to a high power mode in which the output power of the RF signal is maximum.

This is because when the heater temperature is set to a temperature corresponding to a low power mode in which the output power of the RF signal is low, the amount of electrons emitted from the cathode 11 is insufficient at the time of the high power mode and whereby, the output power of the RF signal is saturated at an output power level lower than the required maximum output power.

However, when the cathode temperature is increased by raising the temperature of the heater, an amount of evaporation of the emitter material with which the above-mentioned cathode pellet is impregnated increases. Therefore, a time taken to deplete the entire emitter material is shortened. Further, when the cathode pellet is impregnated with barium (Ba) as the emitter material, not only barium (Ba) evaporates as an oxide but also barium (Ba) itself that is a metal evaporates. Therefore, when the cathode temperature is increased by raising the temperature of the heater, a withstanding voltage characteristic of the traveling wave tube 1 rapidly deteriorates. Accordingly, even when the traveling wave tube 1 is operated in the low power mode for a long time, the product life thereof is shortened by about the product life of the traveling wave tube 1 operated in the high power mode at all times.

Accordingly, when the traveling wave tube 1 is operated in the multi-mode, as described in PTL5, when the traveling wave tube 1 is operated in the high power mode, the temperature of the heater is raised and when the traveling wave tube 1 is operated in the low power mode, the temperature of the heater is lowered. Thus, when the heater temperature is changed according to the operation mode, it is expected that the product life of the traveling wave tube 1 can be extended. However, when the structure in which the heater temperature is changed according to the operation mode is used, another problem described below occurs.

For example, when the traveling wave tube 1 is designed so that the optimal trajectory of the electron beam 50 can be obtained when the traveling wave tube operates in the high power mode, the amount of electrons emitted from the cathode 11 when the traveling wave tube operates in the low power mode is smaller than the amount of electrons emitted from the cathode 11 when the traveling wave tube operates in the high power mode and the diameter of the electron beam 50 becomes small at the time of the low power mode. For this reason, the interaction between the electron beam 50 and the RF signal inputted to the helix 20 becomes weak and whereby, the gain of the traveling wave tube 1 operating in the low power mode becomes smaller than the gain of the traveling wave tube 1 operating in the high power mode. Thus, when the structure in which the gain changes according to the operation mode is used but the output power of the RF signal has to be kept constant even when changing the operation mode, it is necessary to change the electric power of the RF signal inputted to the traveling wave tube 1 according to the operation mode. Therefore, the convenience of the traveling wave tube 1 decreases.

Further, when the traveling wave tube 1 is designed so that the optimal trajectory of the electron beam 50 can be obtained when the traveling wave tube operates in the high power mode, a problem in which an amplification efficiency of the traveling wave tube 1 operating in the low power mode decreases also occurs.

It is known that in the periodic magnetic field generation device mentioned above, when the diameter of the electron beam 50 is small, it is necessary to increase the peak value of a magnetic flux density (refer to PTL2). For this reason, the periodic magnetic field generation device is designed so that the optimal peak value of the magnetic flux density can be obtained according to the diameter of the electron beam 50.

Therefore, when the traveling wave tube operates in the low power mode, the amount of electrons emitted from the cathode 11 is decreased and the diameter of the electron beam 50 is decreased. Whereby, the magnetic flux density obtained by the periodic magnetic field generation device is relatively decreased and a force for focusing the electron beam 50 is decreased. As a result, as shown in FIG. 7, a ripple of which the diameter of the electron beam 50 periodically changes is generated, the interaction between the electron beam 50 and the RF signal becomes weak, and whereby, the amplification efficiency of the traveling wave tube 1 decreases.

On the other hand, when the traveling wave tube 1 is designed so that the optimal trajectory of the electron beam 50 can be obtained when the traveling wave tube operates in the low power mode, the amount of electrons emitted from the cathode 11 when the traveling wave tube operates in the high power mode is greater than the amount of electrons emitted from the cathode 11 when the traveling wave tube operates in the low power mode and the diameter of the electron beam 50 becomes large at the time of the high power mode. Therefore, the interaction between the electron beam and the RF signal inputted to the helix 20 becomes strong, the gain of the traveling wave tube 1 operating in the high power mode is greater than the gain of the traveling wave tube 1 operating in the low power mode, and the RF signal can be easily oscillated. Further, when the diameter of the electron beam 50 is increased, the collision between the electron and the helix 20 easily occurs and whereby, the current (helix current) flowing through the helix 20 increases and the power consumption of the traveling wave tube 1 increases.

The present invention is made to solve the above-mentioned problem. The object of the present invention is to provide a traveling wave tube which is operated in the multi-mode, can extend the product life, and can suppress a gain change and an amplification efficiency change that occur when the operation mode is changed and a high-frequency circuit system.

Solution to Problem

To achieve the above-mentioned object, a traveling wave tube of the present invention comprises:

an electron gun including a cathode for emitting electron and a heater for giving heat energy for emitting the electron from the cathode, a helix in which an electron beam formed of electron emitted from the electron gun interacts with an RF (Radio Frequency) signal, a periodic magnetic field generation device for generating a magnetic field for suppressing the expansion of the electron beam passing through the helix, a collector for capturing the electron beam outputted from the helix, an anode for guiding the electron emitted from the electron gun into the helix, and a magnetic field application device which generates a magnetic field for changing diameter of the electron beam and to which an electric power for generating the magnetic field is supplied from the outside.

In addition, a high-frequency circuit system of the present invention comprises: the traveling wave tube, and a power supply device for supplying a required direct-current voltage to the traveling wave tube; wherein the power supply device comprises:

an anode power supply which can supply one of two or more anode voltages to the anode by changing the anode voltage according to an instruction from an outside, a heater power supply which can supply one of two or more heater voltages to the heater by changing the heater voltage according to an instruction from an outside, and a magnetic field application power supply which can supply one of two or more electric powers to the magnetic field application device by changing the electric power according to an instruction from an outside.

Otherwise, a high-frequency circuit system of the present invention comprises: the traveling wave tube, and a power supply device for supplying a required direct-current voltage to the traveling wave tube; wherein the traveling wave tube includes an electron gun equipped with a wehnelt for focusing electron emitted from the cathode and the power supply device includes:

a wehnelt power supply which can supply one of two or more wehnelt voltages to the wehnelt by changing the wehnelt voltage according to an instruction from an outside, a heater power supply which can supply one of two or more heater voltages to the heater by changing the heater voltage according to an instruction from an outside, and a magnetic field application power supply which can supply one of two or more electric powers to the magnetic field application device by changing the electric power according to an instruction from an outside.

Advantageous Effect of Invention

According to the present invention, in a traveling wave tube operated in the multi-mode, the product life can be extended and a gain change and an amplification efficiency change that occur when the operation mode is changed can be suppressed.

DESCRIPTION OF EMBODIMENTS

Next, an example embodiment of the present invention will be described by using drawings.

Figure 1:
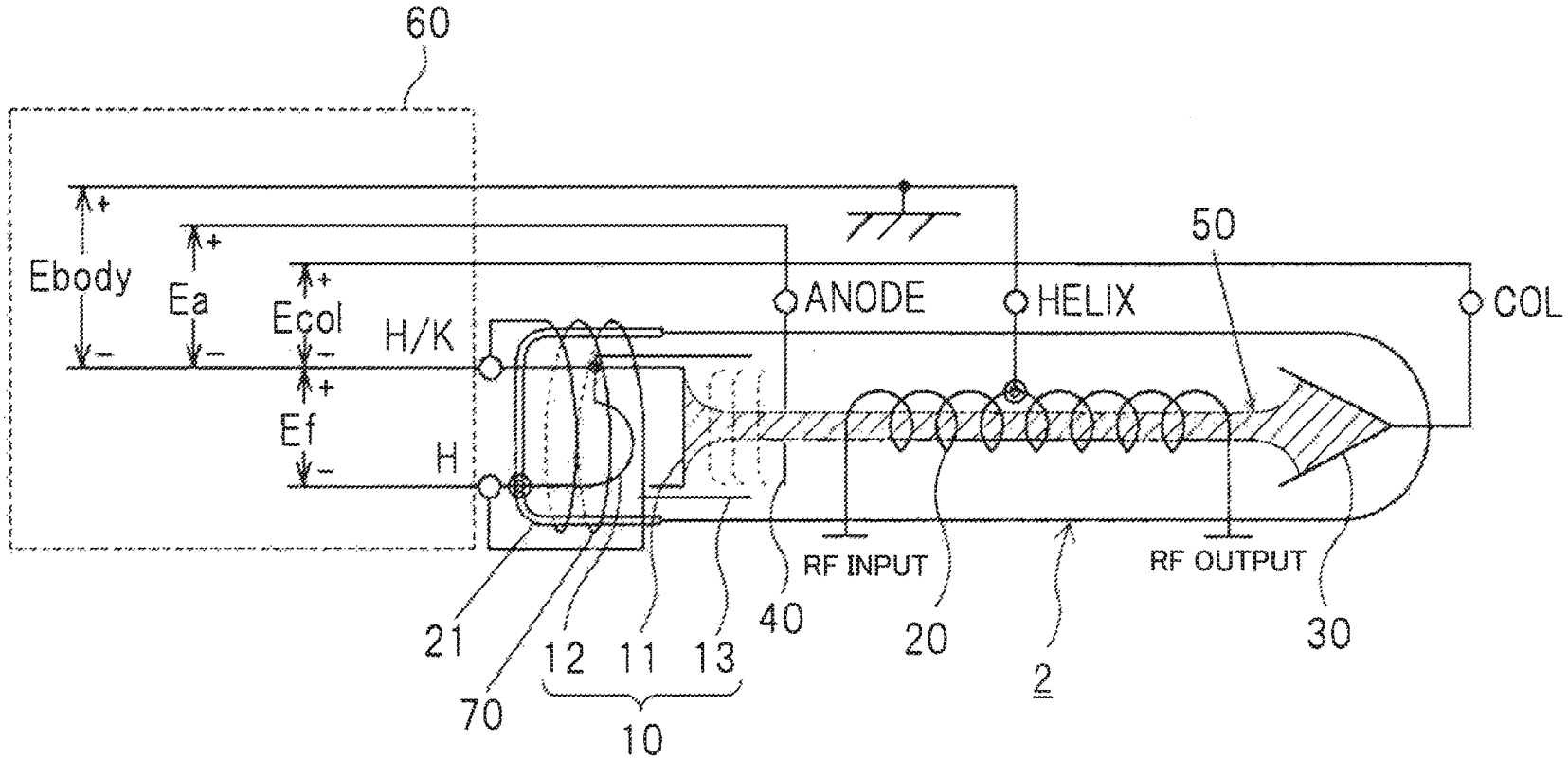
FIG. 1 is a schematic diagram showing an example of a structure of a high-frequency circuit system according to an example embodiment of the present invention.
Figure 2:
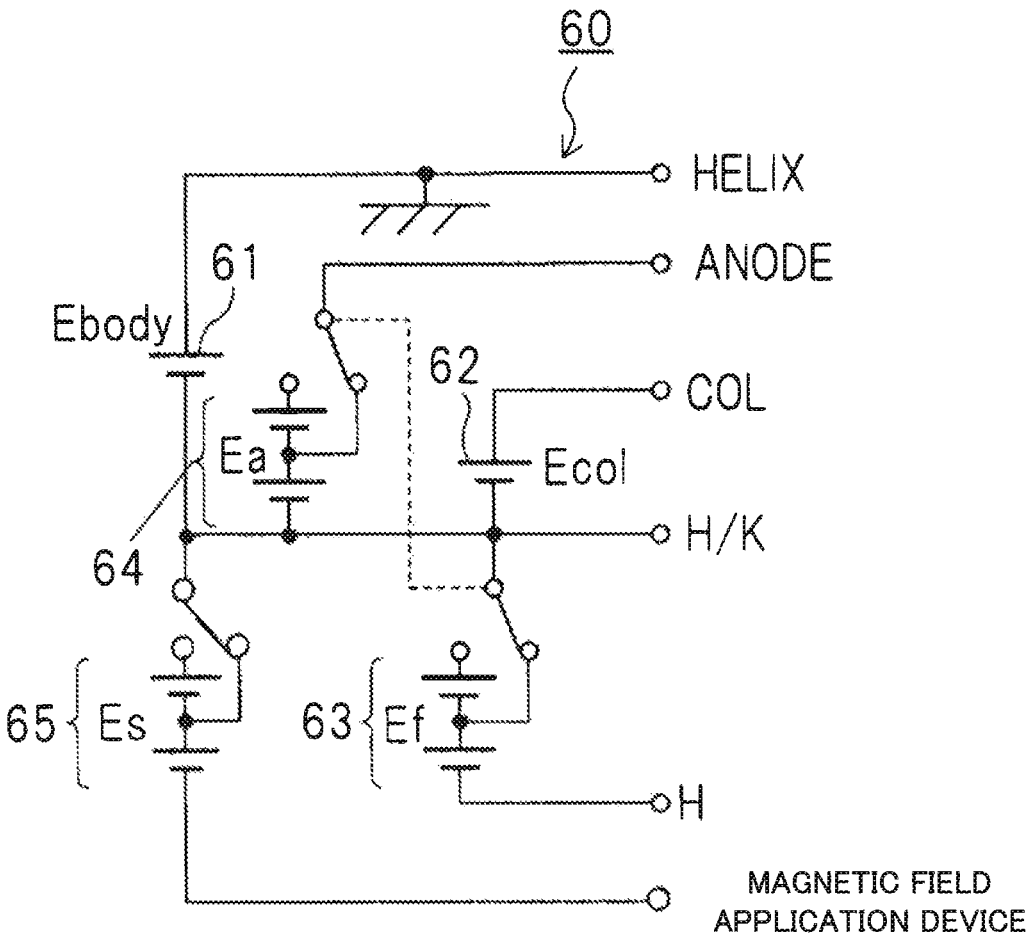
FIG. 2 is a circuit diagram showing an example of a configuration of a power supply device included in a high-frequency circuit system according to an example embodiment of the present invention.
Figure 3:
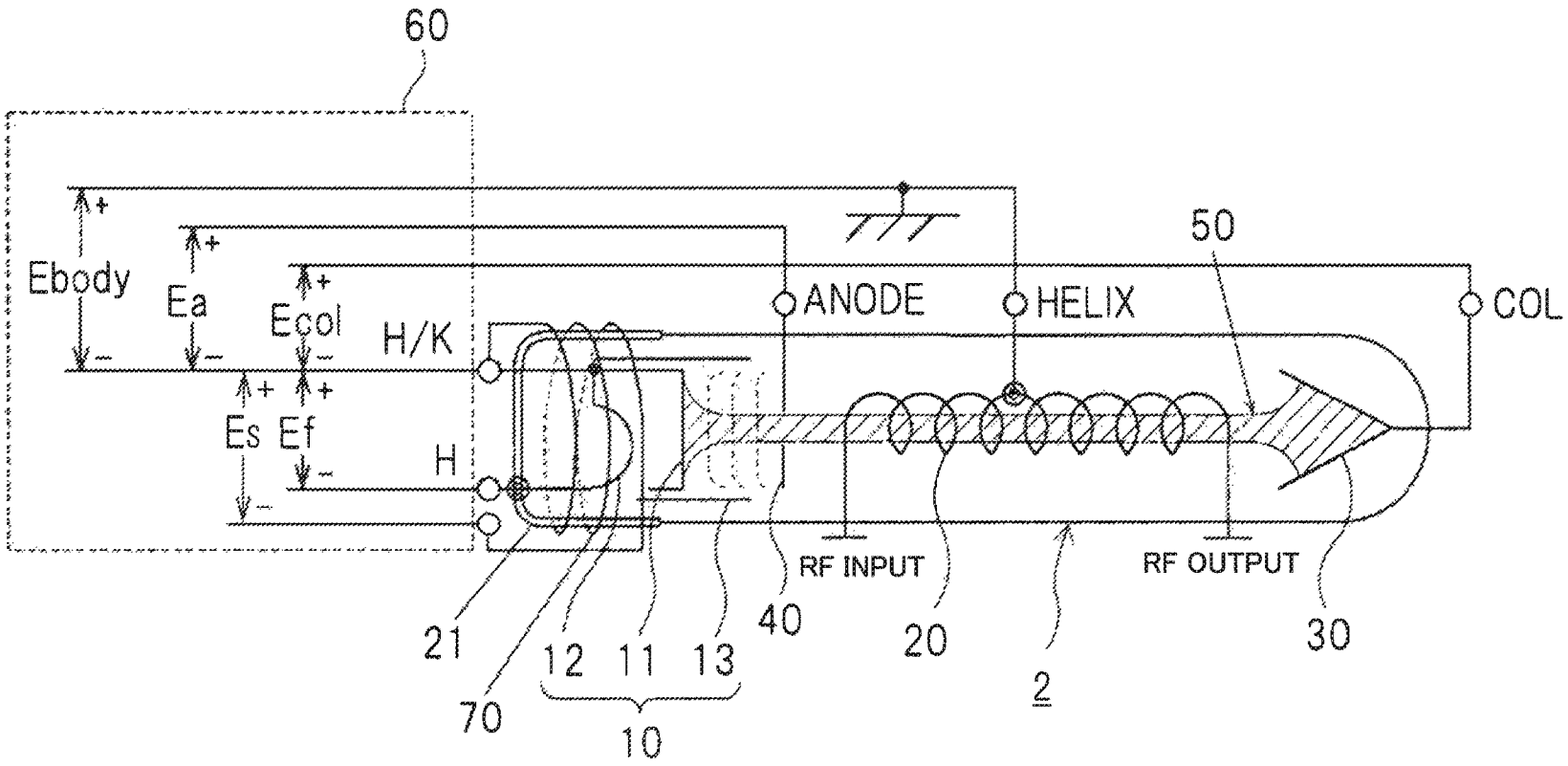
FIG. 3 is a schematic diagram showing an example of another structure of a high-frequency circuit system according to an example embodiment of the present invention.

FIG. 1 is a schematic diagram showing an example of a structure of a high-frequency circuit system according to an example embodiment of the present invention. FIG. 2 is a circuit diagram showing an example of a configuration of a power supply device included in a high-frequency circuit system according to an example embodiment of the present invention. FIG. 3 is a schematic diagram showing an example of another structure of a high-frequency circuit system according to an example embodiment of the present invention.

As shown in FIG. 1, the high-frequency circuit system according to the example embodiment of the present invention includes a traveling wave tube 2, and a power supply device 60 which supplies a required direct-current high voltage (a power supply voltage) to each electrode of the traveling wave tube 2.

Figure 6:
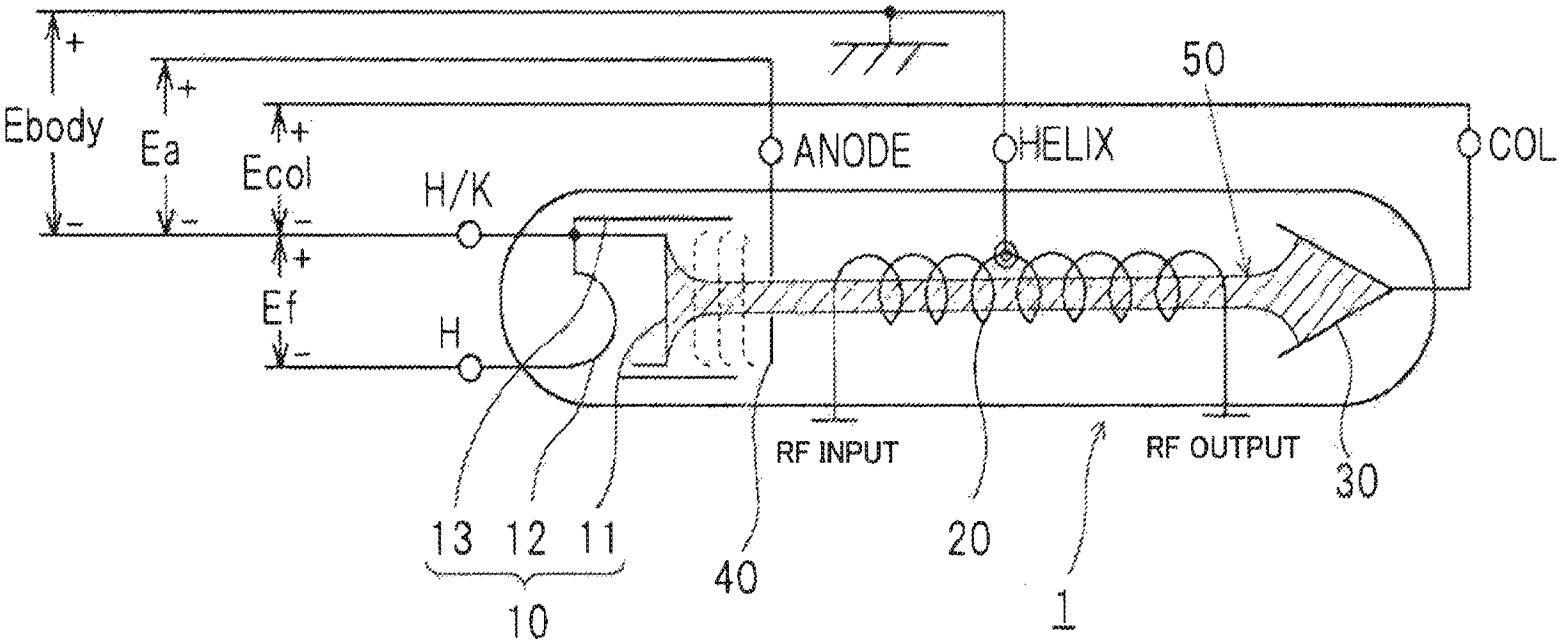
FIG. 6 is a schematic diagram showing an example of a structure of a high-frequency circuit system according to the background art.
Figure 7:
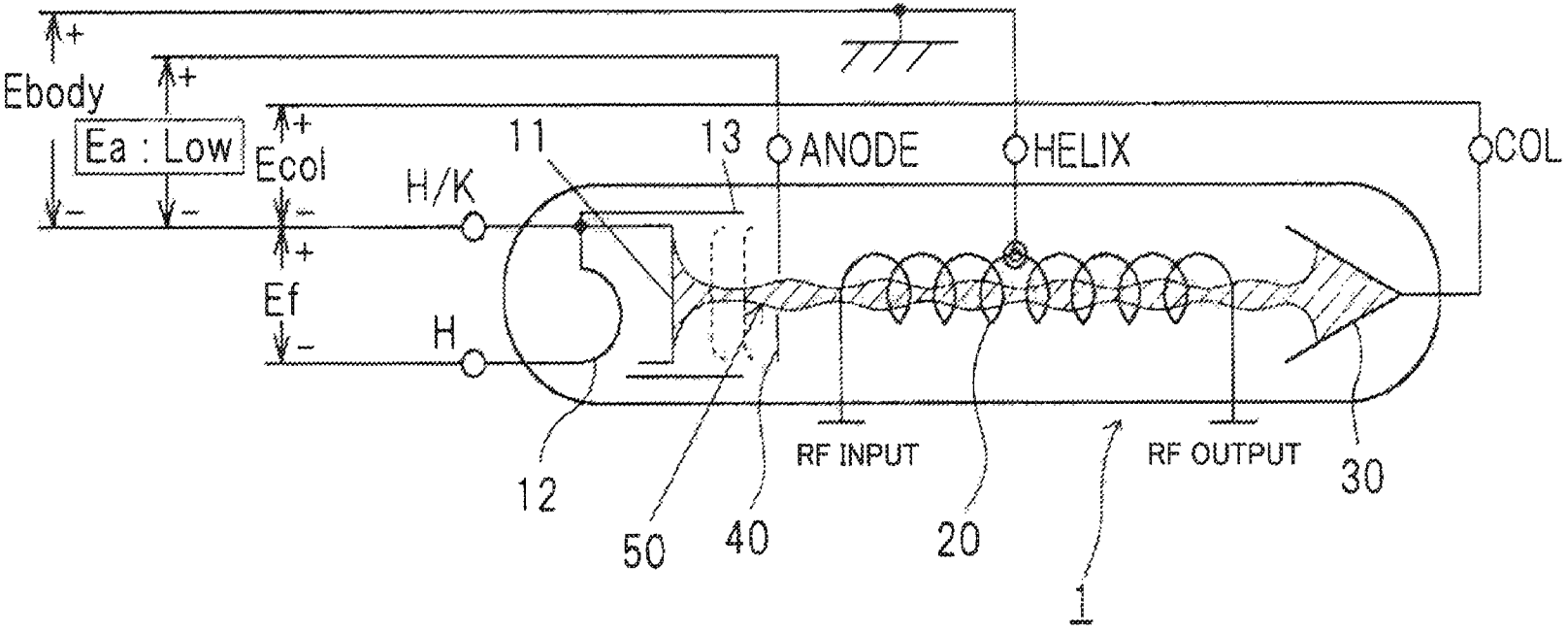
FIG. 7 is a schematic diagram showing a ripple on an electron beam that is generated at a time of a low power mode.

The traveling wave tube 2 according to the example embodiment of the present invention has a structure in which a magnetic field application device 70 which generates the magnetic field for controlling diameter of an electron beam 50 and to which an electric power for generating the magnetic field is supplied from the outside is added to the traveling wave tube 1 according to the background art shown in FIG. 6. The structure other than the above-mentioned structure is the same as that of the traveling wave tube 1 according to the background art shown in FIG. 6. Therefore, the description for the structure other than the above-mentioned structure will be omitted.

The magnetic field application device 70 may be realized by forming a coil between a rear side of an electron gun 10 facing an electron emitting surface and a seal plate 21 for vacuum sealing of a chassis (body) of the traveling wave tube 2. In this case, it is desirable to use the seal plate 21 made of a magnetic metal material (magnetic substance material). By using the seal plate 21 made of the magnetic metal material (magnetic substance material), the magnetic field generated when a current flows through the coil can be strengthened. The coil of the magnetic field application device 70 is formed so that the magnetic field including a magnetic line of force whose direction is approximately orthogonal to the electron emitting surface of a cathode 11 is generated when the current flows through the coil.

Further, the magnetic field application device 70 does not necessarily have a structure in which the coil is made by directly winding a wire around the seal plate 21. The magnetic field application device 70 can have an arbitrary structure in which the coil can generate the magnetic field including the magnetic line of force that is approximately orthogonal to the electron emitting surface of the cathode 11. For example, the magnetic field application device 70 may have a structure in which a ring-shaped magnetic substance core made of a magnetic metal material (magnetic substance material) is disposed in the periphery of the seal plate 21 and the coil is formed on the periphery of the magnetic substance core.

The electric power is supplied to the coil of the magnetic field application device 70 from a magnetic field application power supply 65 described later included in a power supply device 60. In other words, a coil voltage is supplied to the coil of the magnetic field application device 70 from the magnetic field application power supply 65 mentioned later. A heater power supply 63 described later of the power supply device 60 supplies the heater voltage Ef to a heater 12 of the electron gun 10. The magnetic field application power supply 65 may be composed of a dedicated power supply circuit. As described later, the magnetic field application power supply 65 may be integrated with the heater power supply 63 which supplies the electric power to the heater 12. FIG. 1 shows an example of a structure in which the magnetic field application power supply described later is integrated with the heater power supply and the heater power supply supplies the heater voltage Ef to both the magnetic field application device 70 and the heater 12. In FIG. 1, one end of the heater 12 of the electron gun 10 is connected to one end of the coil of the magnetic field application device 70. FIG. 1 shows an example of a structure in which the heater voltage Ef is supplied to the one end of which the one end of the heater 12 and the one end of the coil of the magnetic field application device 70 are connected to each other.

As shown in FIG. 2, the power supply device 60 includes a helix power supply 61, a collector power supply 62, the heater power supply 63, an anode power supply 64, and the magnetic field application power supply 65. The helix power supply 61 of the power supply device 60 supplies the body voltage Ebody that is a negative direct-current voltage determined by using the electric potential HELIX of a helix 20 as a reference to the cathode 11. The collector power supply 62 of the power supply device 60 supplies the collector voltage Ecol that is a positive direct-current voltage determined by using the electric potential H/K of the cathode 11 as a reference to the collector 30. The heater power supply 63 of the power supply device 60 supplies the heater voltage Ef that is a positive or negative direct-current voltage (in FIG. 2, a negative direct-current voltage) determined by using the electric potential H/K of the cathode 11 as a reference to the heater 12. The anode power supply 64 of the power supply device 60 supplies a positive direct-current voltage (anode voltage Ea) determined by using the electric potential H/K of the cathode 11 as a reference to an anode 40. The magnetic field application power supply 65 of the power supply device 60 supplies a coil voltage Es that is a positive or negative direct-current voltage (in FIG. 2, a negative direct-current voltage) determined by using the electric potential H/K of the cathode 11 as a reference to the magnetic field application device 70. For example, the helix 20 is connected to the case (body) of the traveling wave tube 2 and grounded inside the power supply device 60.

In the high-frequency circuit system shown in FIG. 3, the heater 12 receives the heater voltage Ef supplied from the heater power supply 63 of the power supply device 60 shown in FIG. 2 and the coil of the magnetic field application device 70 receives the coil voltage Es supplied from the magnetic field application power supply 65 of the power supply device 60 shown in FIG. 2. In the high-frequency circuit system shown in FIG. 3, the magnetic field application power supply 65 which supplies the coil voltage Es is disposed separately from the heater power supply 63 which supplies the electric power to the heater 12.

Each of the heater power supply 63, the anode power supply 64, and the magnetic field application power supply 65 included in the power supply device 60 according to the example embodiment of the present invention has a structure in which the output voltage can be changed according to the operation mode of the traveling wave tube 2.

For example, the heater power supply 63 has a structure in which a plurality of power supply circuits, each of which generates the heater voltage Ef for each operation mode, are included and the heater voltage Ef supplied to the heater 12 is changed by a switch according to the operation mode of the traveling wave tube 2. FIG. 2 shows an example of a structure in which two power supply circuits connected in series are included and the electric power is supplied to the heater 12 from one of two power supply circuits or two power supply circuits according to the operation mode. As the power supply circuit for generating the heater voltage Ef, for example, a well-known DC-DC converter including an inverter, a transformer, a rectifier circuit, a capacitor for rectification, and the like may be used.

For example, the anode power supply 64 has a structure in which a plurality of power supply circuits, each of which generates the anode voltage Ea for each operation mode, are included and the anode voltage Ea supplied to the anode 40 is changed by a switch according to the operation mode of the traveling wave tube 2. FIG. 2 shows an example of a structure in which two power supply circuits connected in series are included and the electric power is supplied to the anode 40 from one of two power supply circuits or two power supply circuits according to the operation mode. As the power supply circuit for generating the anode voltage Ea, the well-known DC-DC converter may be used like as the heater power supply 63.

When the traveling wave tube 2 is operated in the high power mode, a positive direct-current high voltage (a first anode voltage) that has a large difference from the cathode potential H/K is supplied to the anode 40. The anode power supply 64 may have a structure in which it is connected to the ground potential by using a switch at the time of the high power mode.

On the other hand, when the traveling wave tube 2 is operated in the low power mode, a positive direct-current high voltage (a second anode voltage) that has a small difference from the cathode potential H/K and is smaller than the voltage supplied when the traveling wave tube 2 is operated in the high power mode is supplied to the anode 40.

Further, usually, only a small electric current flows into the anode 40. Accordingly, the anode power supply 64 having a large electric current supply capacity is not required. Therefore, for example, the anode power supply 64 may be realized by using a structure in which a plurality of registers connected in series for dividing the body voltage Ebody and a switch for connecting one of the connection nodes and the anode 40 are included. In this case, one of the node is connected to the anode 40 by the switch according to the operation mode of the traveling wave tube 2.

For example, the magnetic field application power supply 65 has a structure in which a plurality of power supply circuits, each of which generates the coil voltage Es for each operation mode, are included and the coil voltage Es supplied to the magnetic field application device 70 is changed by a switch according to the operation mode of the traveling wave tube 2. FIG. 2 shows an example of a structure in which two power supply circuits connected in series are included and the electric power is supplied to the magnetic field application device 70 from one of two power supply circuits or two power supply circuits according to the operation mode. As the power supply circuit for generating the coil voltage Es, the well-known DC-DC converter may be used like the heater power supply 63. As described later, when the magnetic field for canceling the magnetic flux that leaks from a periodic magnetic field generation device 80 to the cathode 11 is generated by the magnetic field application device 70, the magnetic field application power supply 65 may be integrated with the heater power supply 63. When the magnetic field application power supply 65 is integrated with the heater power supply 63, the strength of the magnetic field generated by the magnetic field application device 70 can be simultaneously changed when the heater voltage Ef is changed according to the operation mode.

The switch provided in the heater power supply 63, the anode power supply 64, and the magnetic field application power supply 65 may be operated by a switch for operation mode switching provided in the chassis of the power supply device 60 or a control signal transmitted from a control device (not shown) or the like.

The helix power supply 61 and the collector power supply 62 generate only the required direct-current high voltage. Therefore, for example, the well-known DC-DC converter including an inverter, a transformer, a rectifier circuit, a capacitor for rectification, and the like may be used for these power supplies. In this case, the inverter and the transformer included in the helix power supply 61, the collector power supply 62, the heater power supply 63, the anode power supply 64, and the magnetic field application power supply 65 can be shared.

Further, the power supply device 60 may include a wehnelt power supply (not shown) which supplies a positive or negative direct-current voltage (wehnelt voltage Ew) determined by using the electric potential H/K of the cathode 11 as a reference to a wehnelt 13. The wehnelt power supply may have a structure in which the direct-current voltage supplied to the wehnelt 13 is changed by the switch according to the operation mode of the traveling wave tube 2 like the anode power supply 64 described above.

In this example embodiment of the present invention, the traveling wave tube 2 shown in FIG. 1 operates in the multi-mode in which the output power of the RF signal is changed by using the anode voltage Ea or the wehnelt voltage Ew. Further, in this example embodiment of the present invention, the heater temperature is changed by changing the heater voltage Ef according to the operation mode of the traveling wave tube 2. Specifically, the heater voltage Ef (the first heater voltage) is set to a high voltage so as to set the heater temperature to a temperature at which the maximum RF output power can be obtained when the traveling wave tube 2 operates in the high power mode. Further, when the traveling wave tube 2 operates in the low power mode, the heater voltage Ef (the second heater voltage) is set to a low voltage so as to set the heater temperature to a temperature at which the required RF output power can be obtained. The operation mode is not limited to two modes: the high power mode and the low power mode. A medium power mode in which the medium RF output power between the maximum RF output power and the required RF output power is outputted may be used.

Thus, when the heater temperature is decreased by decreasing the heater voltage Ef at the time of the low power mode, the amount of evaporation of the emitter material from the cathode 11 at the time of the low power mode can be suppressed. Further, when the amount of evaporation of the emitter material is suppressed, the amount of evaporation of barium (Ba) itself that is a metal is also suppressed. Accordingly, a withstanding voltage characteristic of the traveling wave tube 2 does not rapidly deteriorate. Therefore, the product life of the traveling wave tube 2 can be extended according to a period of time when the traveling wave tube 2 is operated in the low power mode.

Further, in the example embodiment of the present invention, the change in the diameter of the electron beam 50 is suppressed by generating the magnetic field in the neighborhood of the cathode 11 by using the magnetic field application device 70 shown in FIG. 1 and changing the strength of the magnetic field according to the operation mode of the traveling wave tube 2. As a result, the gain change and the amplification efficiency change of the traveling wave tube that occurs when the operation mode is changed can be suppressed.

Because the strength of the magnetic field generated by the magnetic field application device 70 depends on a value of the current flowing through the coil, the strength of the magnetic field generated by the magnetic field application device 70 is changed by changing the coil voltage Es supplied from the magnetic field application power supply 65 according to the operation mode of the traveling wave tube 2.

The diameter of the electron beam 50 can be controlled by the magnetic field generated by the magnetic field application device 70. The reason of this will be explained below by using FIG. 4(*a*) and FIG. 4(*b*).

Figure 4:
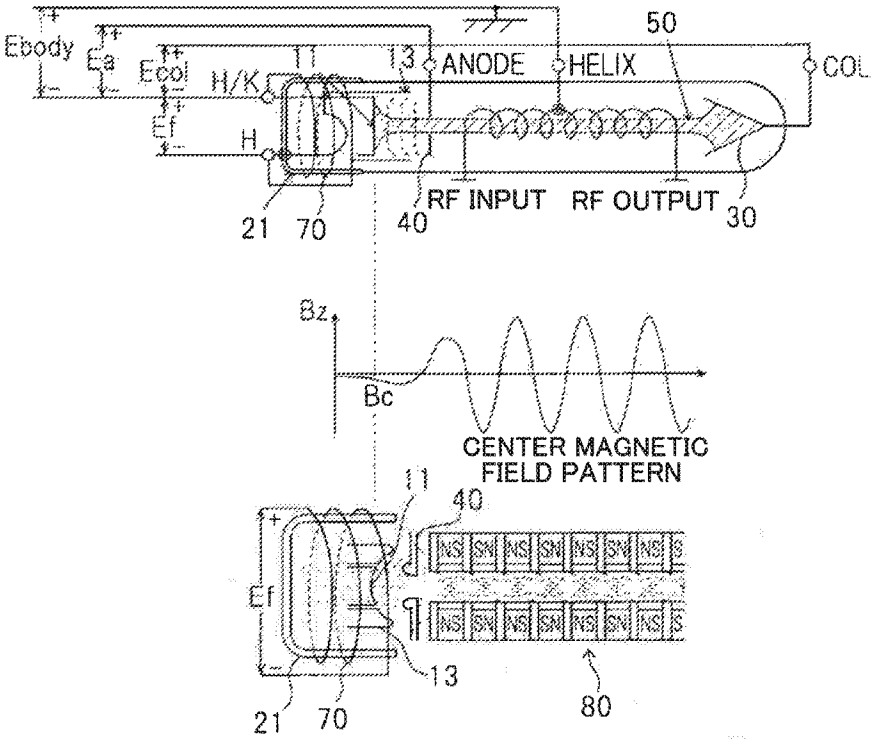
FIG. 4(*a*) is a schematic diagram showing a state of a magnetic field generated by a magnetic field application device and a periodic magnetic field generation device and FIG. 4(*b*) is an enlarged schematic diagram showing a main part of FIG. 4(*a*).
Figure 4:
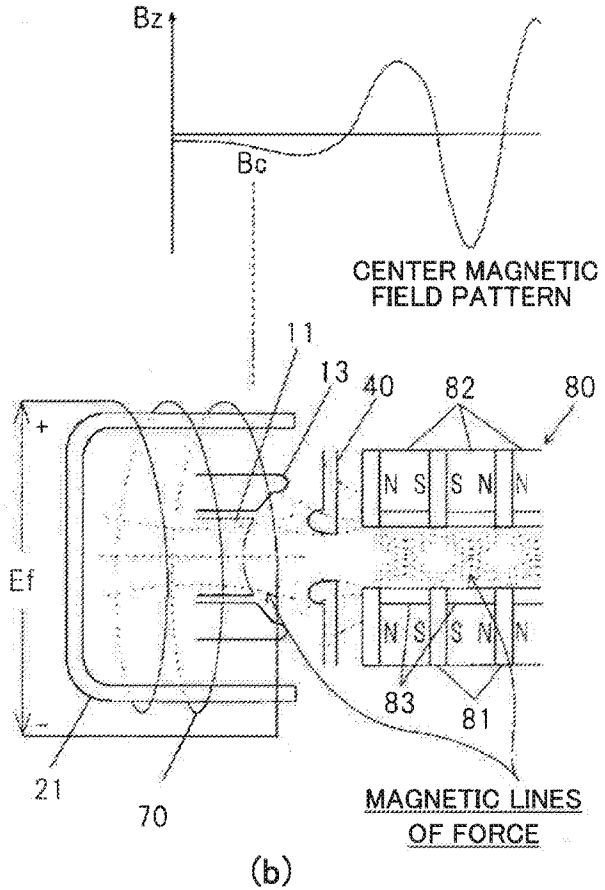

FIG. 4(*a*) is a schematic diagram showing a state of a magnetic field generated by the magnetic field application device and the periodic magnetic field generation device, and FIG. 4(*b*) is an enlarged schematic diagram showing a main part of FIG. 4(*a*).

As shown in FIG. 4(*a*) and FIG. 4(*b*), the periodic magnetic field generation device 80 provided in the traveling wave tube 2 has a structure in which a plurality of ring-shaped pole pieces 81, a plurality of ring-shaped permanent magnets 82, and a plurality of spacers 83 are included. A plurality of the ring-shaped pole pieces 81 are made of a magnetic substance. Each of a plurality of the ring-shaped permanent magnets 82 is arranged between the pole pieces 81 so that the magnetic dipole with a reverse polarity is alternately arranged. The plurality of spacers 83 support a plurality of the permanent magnets 82 mentioned above. Although not shown in FIG. 4(*a*) and FIG. 4(*b*), the helix 20 is arranged in an opening of the periodic magnetic field generation device 80 that is formed in a ring shape.

In such structure, the magnetic field whose magnetic line of force is alternately reversed according to the travel distance of the electron, as shown as a center magnetic field pattern in FIG. 4(*a*) and FIG. 4(*b*), is generated in the opening of the periodic magnetic field generation device 80.

In the traveling wave tube 2, each electron emitted from the cathode 11 travels toward the center by a shape (a spherical surface shape) of the electron emitting surface of the cathode 11 and the electric field generated by the wehnelt 13 and the electrons are converged on a center. The electron that reaches the opening of the periodic magnetic field generation device 80 travels while spirally rotating by the force (Lorentz force) received from the magnetic field generated by the periodic magnetic field generation device 80 and whereby, diffusion of the electrons can be suppressed.

On the other hand, the magnetic flux of the magnetic field (the main magnetic field) generated by the periodic magnetic field generation device 80 leaks to the neighborhood of the cathode 11 and as shown as a center magnetic field pattern in FIG. 4(*a*) and FIG. 4(*b*), the magnetic field with a magnetic flux density Bc is generated in the neighborhood of the electron emitting surface of the cathode 11. When the magnetic field is generated in the neighborhood of the electron emitting surface of the cathode 11, the electron emitted from the cathode 11 receives the force toward outside according to Fleming's left hand rule. Namely, the magnetic field generated in the neighborhood of the electron emitting surface of the cathode 11 by the leakage flux acts so as to expand the electron beam 50. Accordingly, by generating the magnetic field for cancelling the leakage flux by the magnetic field application device 70 and adjusting the strength of the leakage flux, the diameter of the electron beam 50 can be controlled.

Further, in the neighborhood of the electron emitting surface of the cathode 11, the direction in which the electron beam is emitted has axial and radial components and a direction of the radial component is a direction toward the inside because of the structure of the electrode. Because the electron has a negative charge, an electric current direction is opposite to a direction in which the electrons move and is a direction toward the outside. Therefore, "the current flow direction" given by Fleming's left hand rule is the radial direction toward the outside. The magnetic field in "the direction of the magnetic field" given by Fleming's left hand rule is induced by the leakage flux of the periodic magnetic field generation device 80. Therefore, the main component of the magnetic field is the magnetic field in the axial direction. "The force acting on the conductor" is a force acting on the electron and is a force in the direction of the tangent to the circle according to Fleming's left hand rule. Namely, because the electron moves toward the inside and receives the force in the direction of the tangent, the electron moves toward the outside in comparison with an original state in which no magnetic field exists. When the strength of the magnetic field on the cathode electron emitting surface is large, the tangential direction component of the traveling direction of the electron is large. Therefore, the force toward the outside becomes large.

A common traveling wave tube is designed so that the magnetic flux leaked in the neighborhood of cathode 11 from the periodic magnetic field generation device 80 is as small as possible in order to suppress the expansion of the electron beam 50 by the leakage flux of the periodic magnetic field generation device 80. In contrast, the traveling wave tube 2 according to the example embodiment of the present invention is designed so that in the neighborhood of cathode 11, the leakage flux of the periodic magnetic field generation device 80 is greater than that of the common traveling wave tube. In order to get the large leakage flux in the neighborhood of cathode 11, for example, the diameter of the opening of the anode 40 through which the electron passes may be increased when the anode 40 is made of the magnetic substance. Further, as a method for getting a large leakage flux in the neighborhood of cathode 11, a method in which the periodic magnetic field generation device 80 is expanded in a direction toward the cathode 11 (the electron gun) or a method in which the whole periodic magnetic field generation device 80 is disposed near the cathode 11 (the electron gun) may be used.

As shown in FIG. 4(*a*) and FIG. 4(*b*), in general, the direction of the magnetic line of force of the leakage flux is a direction from the periodic magnetic field generation device 80 toward the cathode 11 (a direction toward the left side of the figures). Accordingly, the magnetic field of which the direction of the magnetic line of force is a direction from the cathode 11 toward the periodic magnetic field generation device 80 (a direction toward the right side of figures) is generated by the magnetic field application device 70. For example, the coil is formed by winding a wiring material clockwise around the seal plate 21 to the traveling direction of the electron and when the current flows clockwise through the coil, the magnetic line of force toward the right side of figures is generated according to the well-known right-handed screw rule. When the electron beam 50 having a large diameter is required, the magnetic field generated by the magnetic field application device 70 is weakened (the low coil voltage Es is supplied) and whereby, the magnetic field of the leakage flux is strengthened. In contrast, when the electron beam 50 having a small diameter is required, the magnetic field generated by the magnetic field application device 70 is strengthened (the high coil voltage Es is supplied) and whereby, the magnetic field of the leakage flux is weakened.

As described above, in a case in which the traveling wave tube 2 is designed so that the optimal trajectory of the electron beam 50 can be obtained when the traveling wave tube 2 operates in the high power mode, when the traveling wave tube 2 operates in the low power mode, the amount of electrons emitted from the cathode 11 is decreased and the diameter of the electron beam 50 is decreased in comparison with a case in which the traveling wave tube 2 operates in the high power mode. In this case, the diameter of the electron beam 50 is increased by the diameter approximately equal to the diameter obtained when the traveling wave tube 2 operates in the high power mode by weakening the magnetic field generated by the magnetic field application device 70 by supplying the electric power smaller than the electric power supplied at the time of the high power mode. When the diameter of the electron beam 50 is approximately equal to the diameter obtained when the traveling wave tube 2 operates in the high power mode, the strength of the interaction between the electron beam 50 and the RF signal inputted to the helix 20 becomes approximately equal to the strength obtained when the traveling wave tube 2 operates in the high power mode. Therefore, the reduction of the gain of the traveling wave tube 2 operating in the low power mode can be suppressed. Further, when the diameter of the electron beam 50 is approximately equal to the diameter obtained when the traveling wave tube 2 operates in the high power mode, an amount of ripple of the electron beam 50 is decreased and whereby, the reduction of the amplification efficiency of the traveling wave tube 2 is also suppressed.

On the other hand, in a case in which the traveling wave tube 2 is designed so that the optimal trajectory of the electron beam 50 can be obtained when the traveling wave tube 2 operates in the low power mode, when the traveling wave tube 2 operates in the high power mode, the amount of electrons emitted from the cathode 11 is increased and the diameter of the electron beam 50 is increased in comparison with a case in which the traveling wave tube 2 operates in the low power mode. In this case, the diameter of the electron beam 50 is decreased by the diameter approximately equal to the diameter obtained when the traveling wave tube 2 operates in the low power mode by strengthening the magnetic field generated by the magnetic field application device 70 by supplying the electric power greater than the electric power supplied at the time of the low power mode. When the diameter of the electron beam 50 is approximately equal to the diameter obtained when the traveling wave tube 2 operates in the low power mode, the strength of the interaction between the electron beam 50 and the RF signal inputted to the helix 20 becomes approximately equal to the strength obtained when the traveling wave tube 2 operates in the low power mode. Therefore, the increase of the gain of the traveling wave tube 2 can be suppressed and whereby, a possibility that the traveling wave tube 2 oscillates is reduced.

Figure 5:
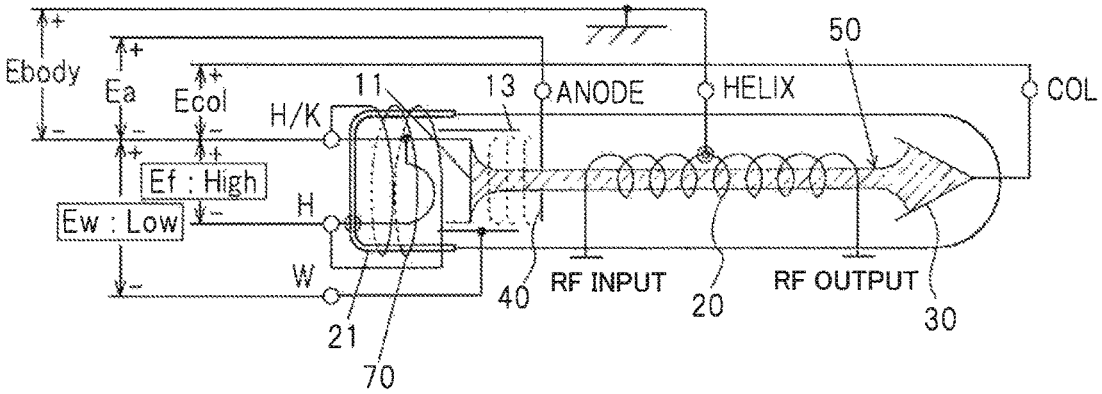
FIG. 5(*a*) is a schematic diagram showing operation at a time of a high power mode of a modification example of a high-frequency circuit system according to an example embodiment of the present invention, and FIG. 5(*b*) is a schematic diagram showing operation at a time of a low power mode of a modification example of a high-frequency circuit system according to an example embodiment of the present invention.
Figure 5:
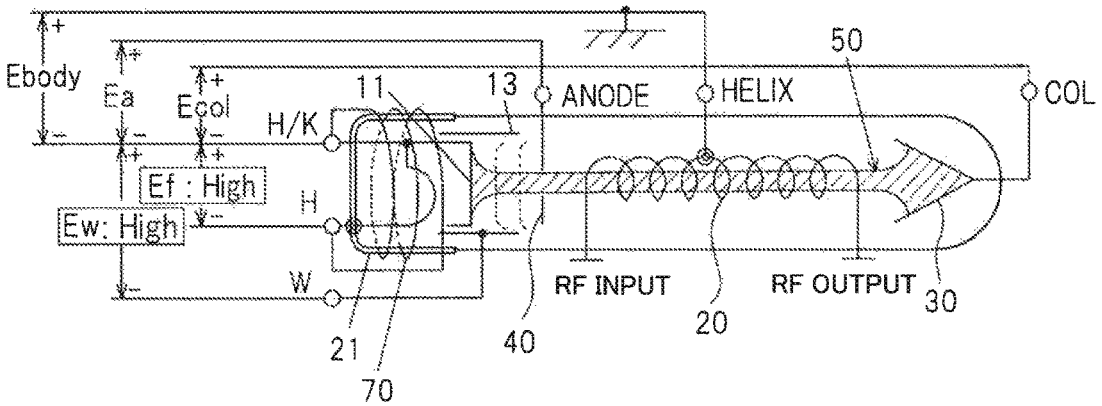

Further, in the above-mentioned description, an example in which the electric power of the RF signal outputted from the traveling wave tube 2 is changed by the anode voltage Ea has been explained by using FIG. 1, FIG. 2, FIG. 4(*a*), and FIG. 4(*b*). However, as mentioned above, the electric power of the RF signal outputted from the traveling wave tube 2 can also be controlled by the wehnelt voltage Ew. FIG. 5(*a*) and FIG. 5(*b*) show an example of a structure in which the output power of the RF signal is changed by the wehnelt voltage Ew as shown above.

FIG. 5(*a*) is a schematic diagram showing operation at the time of the high power mode of a modification example of the high-frequency circuit system according to the example embodiment of the present invention, and FIG. 5(*b*) is a schematic diagram showing operation at the time of the low power mode of a modification example of the high-frequency circuit system according to the example embodiment of the present invention. Further, FIG. 5(*a*) and FIG. 5(*b*) show an example of a structure in which the electric power is supplied from the heater power supply 63 to the magnetic field application device 70 like the structure shown in FIG. 1.

As shown in FIG. 5(*a*) and FIG. 5(*b*), when the electric power of the RF signal outputted from the traveling wave tube 2 is controlled by the wehnelt voltage Ew, the negative direct-current voltage (wehnelt voltage Ew) determined by using, for example the electric potential H/K of the cathode 11 as a reference is supplied to the wehnelt 13.

When the traveling wave tube 2 is operated in the high power mode, as shown in FIG. 5(*a*), the negative direct-current voltage (first wehnelt voltage Ew: Low) having a small difference with the cathode potential H/K is supplied to the wehnelt 13. Further, at the time of the high power mode, the electric potential of the wehnelt 13 may be equal to the electric potential H/K of the cathode 11 and the positive direct-current voltage determined by using the electric potential H/K of the cathode 11 as a reference may be supplied to the wehnelt 13.

On the other hand, as shown in FIG. 5(*b*), when the traveling wave tube 2 is operated in the low power mode, the negative direct-current high voltage (second wehnelt voltage Ew: High) higher than the direct-current voltage supplied at the time of the high power mode is supplied to the wehnelt 13.

The operation for changing the heater temperature and the operation for changing the magnetic field generated by the magnetic field application device 70 are similar to the above-mentioned operation for changing the output power of the RF signal by the anode voltage Ea. Therefore, the description will be omitted.

Further, in the above-mentioned description, an example in which the magnetic field application device 70 generates the magnetic field for canceling the leakage flux of the periodic magnetic field generation device 80 has been described. However, the magnetic field application device 70 may generate the magnetic field for strengthening the leakage flux of the periodic magnetic field generation device 80. Namely, in FIG. 4(*a*) and FIG. 4(*b*), the magnetic field application device 70 may generate the magnetic field of which the direction of the magnetic line of force is the direction from the periodic magnetic field generation device 80 toward the cathode 11 (the direction toward the left side of figures). In this case, the traveling wave tube 2 according to the example embodiment of the present invention may be designed so that the leakage flux of the periodic magnetic field generation device 80 in the neighborhood of cathode 11 is decreased like the common traveling wave tube.

In the case in which the traveling wave tube 2 is designed so that the optimal trajectory of the electron beam 50 can be obtained when the traveling wave tube 2 operates in the high power mode, the magnetic field generated by the magnetic field application device 70 is strengthened by supplying an electric power greater than the electric power supplied at the time of the high power mode to the magnetic field application device 70 when the traveling wave tube operates in the low power mode. Thus, at the time of the low power mode, the diameter of the electron beam 50 may be increased by the diameter approximately equal to the diameter obtained when the traveling wave tube 2 is operated in the high power mode.

Further, in the case in which the traveling wave tube 2 is designed so that the optimal trajectory of the electron beam 50 can be obtained when the traveling wave tube 2 operates in the low power mode, the magnetic field generated by the magnetic field application device 70 is weakened by supplying an electric power smaller than the electric power supplied at the time of the low power mode to the magnetic field application device 70 when the traveling wave tube 2 operates in the high power mode. Thus, at the time of the high power mode, the diameter of the electron beam 50 may be decreased by the diameter approximately equal to the diameter obtained when the traveling wave tube 2 is operated in the low power mode. In such structure, the magnetic field application power supply 65 cannot be integrated with the heater power supply 63. However, by using the above-mentioned method, the diameter of the electron beam 50 can be controlled by the magnetic field generated by the magnetic field application device 70.

In the example embodiment of the present invention, a structure in which the heater temperature is changed according to the operation mode is used. Therefore, when the heater temperature at the time of the low power mode is decreased, the amount of evaporation of the emitter material from the cathode 11 at the time of the low power mode can be suppressed. Further, when the amount of evaporation of the emitter material is suppressed, the amount of evaporation of barium (Ba) itself that is a metal is also suppressed and whereby, a withstanding voltage characteristic of the traveling wave tube 2 does not rapidly deteriorate. Therefore, the product life of the traveling wave tube 2 can be extended according to a period of time when the traveling wave tube 2 is operated in the low power mode.

Further, the magnetic field application device 70 is disposed in the traveling wave tube 2, the strength of the magnetic field generated in the neighborhood of the cathode by the magnetic field application device 70 is changed according to the operation mode, and whereby, the change of the diameter of the electron beam 50 caused by the change of the operation mode can be suppressed. Accordingly, the product life of the traveling wave tube 2 can be extended and the gain change and the amplification efficiency change of the traveling wave tube 2 that occur when the operation mode is changed can be suppressed.

The present invention has been described above by taking the above-mentioned example embodiment as an exemplary example. However, the present invention is not limited to the example embodiment mentioned above. Namely, various changes in the configuration or details of the invention of the present application that can be understood by those skilled in the art can be made without departing from the scope of the invention of the present application.

This application is based upon and claims the benefit of priority from Japanese patent application No. 2014-133645, filed on Jun. 30, 2014, the disclosure of which is incorporated herein in its entirety by reference.

This application claims priority from Japanese Patent Application No. 2014-133645, filed on Jun. 30, 2014, the disclosure of which is hereby incorporated by reference in its entirety.

REFERENCE SIGNS LIST

1, 2 traveling wave tube
10 electron gun
11 cathode
12 heater
13 wehnelt
20 helix
30 collector
40 anode
50 electron beam
60 power supply device
61 helix power supply
62 collector power supply
63 heater power supply
64 anode power supply
65 magnetic field application power supply
70 magnetic field application device
80 periodic magnetic field generation device
81 pole piece
82 permanent magnet
83 spacer

What is claimed is:

1. A traveling wave tube comprising:

an electron gun including a cathode for emitting electrons and a heater for generating heat energy for emitting electrons from the cathode, a helix in which an electron beam formed of electrons emitted from the electron gun interacts with an RF (Radio Frequency) signal, a periodic magnetic field generation device for generating a magnetic field for suppressing expansion of the electron beam passing through the helix, a collector for capturing the electron beam outputted from the helix, an anode for guiding the electrons emitted from the electron gun into the helix, and a magnetic field application device which generates a magnetic field for changing a diameter of the electron beam, and to which an electric power for generating the magnetic field is supplied from the outside, wherein the traveling wave tube is configured so that an optimal trajectory of the electron beam is obtained when operating in a high power mode, and when the traveling wave tube operates in a low power mode, the magnetic field application device operates with an electric power smaller than an electric power supplied during a high power mode.

2. The traveling wave tube according to claim 1, wherein the magnetic field application device generates the magnetic field with a magnetic line of force whose direction is approximately orthogonal to the electron emitting surface of the cathode.

3. The traveling wave tube according to claim 1, wherein the magnetic field application device is a coil formed on a seal plate for sealing a chassis from a rear direction of the electron gun that faces the electron emitting surface.

4. The traveling wave tube according to claim 3, wherein the seal plate is made of a magnetic substance material.

5. The traveling wave tube according to claim 1, wherein the magnetic field application device comprises:

a magnetic substance core that is disposed in periphery of a seal plate for sealing the chassis from a rear direction of the electron gun that faces the electron emitting surface and made of a magnetic substance material, and a coil formed on the periphery of the magnetic substance core.

6. A high-frequency circuit system comprising the traveling wave tube according to claim 1, and a power supply device for supplying a required direct-current voltage to the traveling wave tube; wherein the power supply device comprises:

an anode power supply which is configured to supply one of two or more anode voltages to the anode by changing the anode voltage according to an external instruction, a heater power supply which is configured to supply one of two or more heater voltages to the heater by changing the heater voltage according to an external instruction, and a magnetic field application power supply which is configured to supply one of two or more electric powers to the magnetic field application device by changing the electric power according to an external instruction.

7. The high-frequency circuit system described in claim 6, wherein:

the anode power supply supplies a first anode voltage to the anode when in a high power mode of the traveling wave tube at which an output power of an RF signal is maximum, and supplies a second anode voltage lower than the first anode voltage to the anode when in a low power mode at which the output power of the RF signal is low compared with the output power of the RF signal in the high power mode;

the heater power supply supplies a first heater voltage to the heater in the high power mode, and supplies a second heater voltage lower than the first heater voltage to the heater in the low power mode; and the magnetic field application power supply supplies the electric power smaller than the electric power supplied during the high power mode to the magnetic field application device during the low power mode in a case in which the traveling wave tube is designed so that the optimal trajectory of the electron beam is configured to be obtained when the traveling wave tube operates in the high power mode.

8. The high-frequency circuit system according to claim 6, wherein when a magnetic field for canceling a magnetic flux leaked from the periodic magnetic field generation device to the cathode is generated by the magnetic field application device, the magnetic field application power supply is integrated with the heater power supply.

9. A high-frequency circuit system comprising the traveling wave tube according to claim 1, and a power supply device for supplying a required direct-current voltage to the traveling wave tube, wherein the traveling wave tube includes an electron gun equipped with a wehnelt for focusing electrons emitted from the cathode and the power supply device includes:

a wehnelt power supply which is configured to supply one of two or more wehnelt voltages to the wehnelt by changing the wehnelt voltage according to an external instruction, a heater power supply which is configured to supply one of two or more heater voltages to the heater by changing the heater voltage according to an external instruction, and a magnetic field application power supply which is configured to supply one of two or more electric powers to the magnetic field application device by changing the electric power according to an external instruction.

10. The high-frequency circuit system according to claim 9, wherein:

the wehnelt power supply supplies a first wehnelt voltage that is a negative voltage to the wehnelt during the high power mode of the traveling wave tube at which an output power of the RF signal is maximum, and supplies a second wehnelt voltage that is a negative voltage higher than the first wehnelt voltage to the wehnelt during the low power mode of the traveling wave tube at which the output power of the RF signal is smaller than the output power of the RF signal during the high power mode;

the heater power supply supplies a first heater voltage to the heater during the high power mode, and supplies a second heater voltage lower than the first heater voltage to the heater during the low power mode; and the magnetic field application power supply supplies an electric power smaller than the electric power supplied during the high power mode to the magnetic field application device during the low power mode in a case in which the traveling wave tube is designed so that the optimal trajectory of the electron beam is configured to be obtained when the traveling wave tube operates in the high power mode.

11. A traveling wave tube comprising:

an electron gun including a cathode for emitting electrons and a heater for generating heat energy for emitting electrons from the cathode, a helix in which an electron beam formed of electrons emitted from the electron gun interacts with an RF (Radio Frequency) signal, a periodic magnetic field generation device for generating a magnetic field for suppressing expansion of the electron beam passing through the helix, a collector for capturing the electron beam outputted from the helix, an anode for guiding the electrons emitted from the electron gun into the helix, and a magnetic field application device which generates a magnetic field for changing a diameter of the electron beam, and to which an electric power for generating the magnetic field is supplied from the outside, wherein the traveling wave tube is configured so that an optimal trajectory of the electron beam is obtained when operating in a low power mode, and when the traveling wave tube operates in a high power mode, the magnetic field application device operates with an electric power larger than an electric power supplied during a low power mode.

12. The traveling wave tube according to claim 11, wherein the magnetic field application device generates the magnetic field with a magnetic line of force whose direction is approximately orthogonal to the electron emitting surface of the cathode.

13. The traveling wave tube according to claim 11, wherein the magnetic field application device is a coil formed on a seal plate for sealing a chassis from a rear direction of the electron gun that faces the electron emitting surface.

14. The traveling wave tube according to claim 13, wherein the seal plate is made of a magnetic substance material.

15. The traveling wave tube according to claim 11, wherein the magnetic field application device comprises:

a magnetic substance core that is disposed in periphery of a seal plate for sealing the chassis from a rear direction of the electron gun that faces the electron emitting surface and made of a magnetic substance material, and a coil formed on the periphery of the magnetic substance core.

16. A high-frequency circuit system comprising the traveling wave tube according to claim 11, and a power supply device for supplying a required direct-current voltage to the traveling wave tube; wherein the power supply device comprises:

an anode power supply which is configured to supply one of two or more anode voltages to the anode by changing the anode voltage according to an external instruction, a heater power supply which is configured to supply one of two or more heater voltages to the heater by changing the heater voltage according to an external instruction, and a magnetic field application power supply which is configured to supply one of two or more electric powers to the magnetic field application device by changing the electric power according to an external instruction.

17. The high-frequency circuit system described in claim 16, wherein:

the anode power supply supplies a first anode voltage to the anode when in a high power mode of the traveling wave tube at which an output power of an RF signal is maximum, and supplies a second anode voltage lower than the first anode voltage to the anode when in a low power mode at which the output power of the RF signal is low compared with the output power of the RF signal in the high power mode;

the heater power supply supplies a first heater voltage to the heater in the high power mode, and supplies a second heater voltage lower than the first heater voltage to the heater in the low power mode; and the magnetic field application power supply supplies the electric power greater than the electric power supplied during the low power mode to the magnetic field application device during the high power mode in a case in which the traveling wave tube is designed so that the optimal trajectory of the electron beam is configured to be obtained when the traveling wave tube operates in the low power mode.

18. The high-frequency circuit system according to claim 16, wherein when a magnetic field for canceling a magnetic flux leaked from the periodic magnetic field generation device to the cathode is generated by the magnetic field application device, the magnetic field application power supply is integrated with the heater power supply.

19. A high-frequency circuit system comprising the traveling wave tube according to claim 11, and a power supply device for supplying a required direct-current voltage to the traveling wave tube, wherein the traveling wave tube includes an electron gun equipped with a wehnelt for focusing electrons emitted from the cathode and the power supply device includes:

a wehnelt power supply which is configured to supply one of two or more wehnelt voltages to the wehnelt by changing the wehnelt voltage according to an external instruction, a heater power supply which is configured to supply one of two or more heater voltages to the heater by changing the heater voltage according to an external instruction, and a magnetic field application power supply which is configured to supply one of two or more electric powers to the magnetic field application device by changing the electric power according to an external instruction.

20. The high-frequency circuit system according to claim 19, wherein:

the wehnelt power supply supplies a first wehnelt voltage that is a negative voltage to the wehnelt during the high power mode of the traveling wave tube at which an output power of the RF signal is maximum, and supplies a second wehnelt voltage that is a negative voltage higher than the first wehnelt voltage to the wehnelt during the low power mode of the traveling wave tube at which the output power of the RF signal is smaller than the output power of the RF signal during the high power mode;

the heater power supply supplies a first heater voltage to the heater during the high power mode, and supplies a second heater voltage lower than the first heater voltage to the heater during the low power mode; and the magnetic field application power supply supplies an electric power greater than the electric power supplied during the low power mode to the magnetic field application device during the high power mode in a case in which the traveling wave tube is designed so that the optimal trajectory of the electron beam is configured to be obtained when the traveling wave tube operates in the low power mode.

* * * * *